US006709535B2

(12) United States Patent
Utsumi et al.

(10) Patent No.: US 6,709,535 B2
(45) Date of Patent: Mar. 23, 2004

(54) SUPERHIGH-STRENGTH DUAL-PHASE STEEL SHEET OF EXCELLENT FATIGUE CHARACTERISTIC IN A SPOT WELDED JOINT

(75) Inventors: Yukihiro Utsumi, Kakogawa (JP); Yoshinobu Omiya, Kakogawa (JP); Manabu Kamura, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 10/157,071

(22) Filed: May 30, 2002

(65) Prior Publication Data

US 2003/0221752 A1 Dec. 4, 2003

(51) Int. Cl.[7] ..... C22C 38/22; C22C 38/32
(52) U.S. Cl. ..... 148/334; 428/653; 428/659
(58) Field of Search ..... 428/653, 659; 148/334; 420/34

(56) References Cited

U.S. PATENT DOCUMENTS

| | | | | |
|---|---|---|---|---|
| 6,306,527 | B1 | 10/2001 | Ikeda et al. | |
| 6,312,536 | B1 * | 11/2001 | Omiya et al. | 148/533 |
| 6,316,127 | B1 | 11/2001 | Ikeda et al. | |
| 6,440,584 | B1 * | 8/2002 | Nagataki et al. | 148/533 |

FOREIGN PATENT DOCUMENTS

| | | |
|---|---|---|
| JP | 3-199343 | 8/1991 |
| JP | 4-128320 | 4/1992 |
| JP | 4-128321 | 4/1992 |
| JP | 4-173945 | 6/1992 |
| JP | 4-173946 | 6/1992 |
| JP | 5-105960 | 4/1993 |
| JP | 5-186849 | 7/1993 |
| JP | 5-331537 | 12/1993 |
| JP | 9-25537 | 1/1997 |
| JP | 9-263883 | 10/1997 |
| JP | 2000-87175 | 3/2000 |

OTHER PUBLICATIONS

U.S. patent application Ser. No. 09/793,579, filed Feb. 27, 2001, pending.
U.S. patent application Ser. No. 09/909,908, filed Jul. 23, 2001, pending.
U.S. patent application Ser. No. 10/015,633, filed Dec. 17, 2001, pending.
U.S. patent application Ser. No. 10/614,821, Akamizu, et al., filed Jul. 9, 2003.
U.S. patent application Ser. No. 10/157, 071, Utsumi, et al., filed May 30, 2002.

* cited by examiner

*Primary Examiner*—Deborah Yee
(74) *Attorney, Agent, or Firm*—Oblon, Spivak, McClelland, Maier & Neustadt, P.C.

(57) ABSTRACT

A superhigh-strength dual-phase steel sheet containing ferritic microstructure and a martensitic microstructure—containing composite-phase steel sheet containing:

C: 0.08–0.20% (mass% here and hereinafter),

Si: 0.5% or less (inclusive of 0%)

Mn: 3.0% or less (exclusive of 0%)

P: 0.02% or less (inclusive of 0%)

S: 0.02% or less (inclusive of 0%), and

Al: 0.001–0.15%, and further containing

Mo: 0.05–1.5%, and

Cr: 0.05–1.5%, and which satisfying that:

the average Vickers hardness of the ferritic microstructure is 150 Hv or more and the average Vickers hardness of the martensitic microstructure is 500 Hv or more, the superhigh-strength dual-phase steel sheets being of excellent fatigue characteristic in a spot welded joint.

9 Claims, 1 Drawing Sheet

SUPERHIGH-STRENGTH DUAL-PHASE STEEL SHEET OF EXCELLENT FATIGUE CHARACTERISTIC IN A SPOT WELDED JOINT

BACKGROUND OF THE INVENTION

1. Field of the Invention

The present invention relates to a dual-phase steel sheet of excellent fatigue characteristic in a spot welded joint. More in particular, it relates to a superhigh-strength dual-phase steel sheet having a tensile strength of about 780 to 1270 MPa.

2. Description of the Prior Art

Recently, demands for improvement of safety on automobiles have been increased more and more. From the view points of ensuring the drivers' safety in a car crash as well as improving the fuel cost by reducing the weight of car bodies that has been increasing owing to attachment of safety equipments, the technique of applying high strength steel sheets to frame portions of car bodies has come to be adopted rapidly. Especially for preventing the frame portions from being flexed and intruded into a cabin at the time of the side impact, there comes to be used superhigh-strength steel sheets having a tensile strength of about 780 to 1180 MPa.

The superhigh-strength steel sheets for car components have generally employed dual-phase steel sheets comprising ferrite and martensite with the ferritic microstructure being as a matrix phase in which: coarse island martensite is dispersed at the triple point of the ferrite grain boundary; or martensite is connected in a network-shape. Nevertheless it is generally considered that it is difficult to ensure sufficient ductility in superhigh-strength steel sheets of 780 MPa or more, the dual-phase steel sheets have been employed. This is because the jig sheets can improve the ductility by the soft ferrite microstructure and also ensure a predetermined strength by the martensitic microstructure. This permits of steel sheets excellent both in the strength and the ductility and also excellent in the weldability.

The dual-phase steel sheets are disclosed in JP-A Nos. (1) 128320/1992, (2) 173946/1992, and (3) 105960/1993. Each of them has superhigh-strength of 780 MPa or more and excellent ductility. However, the gist of these techniques is to make steel sheets compatible with strength and formability. Thus, when the tensile strength in the superhigh-strength steel sheet increases to about 780 to 1180 MPa as shown in the present invention, the amount of elements such as C, Mn that ensure strength tends also to increase remarkably even on a dual-phase steel sheet, causing the lowering of weldability. Currently, no effective means for the defect has not yet been studied.

Generally, dual-phase steel sheets have two problem: since spot welded nugget portions (lens-shaped molten and solidified portion formed when metal sheets are stacked to each other and spot welded) tend to be hardened while the heat-affected zone (HAZ) is tend to be softened, difference of hardness between them increases; and defects such as micro-cracks are formed near the weld zone including the welded nugget portions. These cause the fatigue characteristic to be lowered remarkably, particularly, on the welded joint portion. The steel sheets described above also involve the same problems in the conventional dual-phase steel sheets and improvement has been demanded keenly for the fatigue characteristic of the spot welded joint.

On the other hand, examples for improving the strength of the welded joint portion are described in JPA-Nos. (4) 199343/1991, (5) 186849/1993, and (6) 87175/2000.

Of these, (4) is directed to extra-low carbon steels with C content of 0.006% or less. Thus no desired superhigh-strength can be obtained; (5) and (6) are intended to prevent the heat-affected zone from softening like in this invention. However, since predestined plastic strain is applied to a steel sheet for work hardening, the ductility is lowered remarkably, so these are not practical.

Accordingly, strongly demanded is a novel dual-phase steel sheet having high strength and ductility that is improved with the fatigue characteristic in the welded joint portion.

SUMMARY OF THE INVENTION

Under the circumstances, the present invention aims at providing a superhigh-strength dual-phase steel sheet having strength of about 780 to 1180 MPa, as well as being improved in the fatigue characteristic for the welded joint portion.

In carrying out our invention in one preferred mode, we utilizes superhigh-strength dual-phase steel sheet that is a ferritic microstructure and martensitic microstructure—containing dual-phase steel sheet containing:

C: 0.08–0.20% (mass% here and hereinafter),

Si: 0.5% or less (inclusive of 0%)

Mn: 3.0% or less (exclusive of 0%)

P: 0.02% or less (inclusive of 0%)

S: 0.02% or less (inclusive of 0%), and

Al: 0.001–0.15%, further containings

Mo: 0.05–1.5%, and

Cr: 0.05–1.5%, and satisfying:

the average Vickers hardness of the ferritic microstructure of 150 Hv or more and the average Vickers hardness of the martensitic microstructure of 500 Hv or more.

Other and further objects, features and advantages of the invention will appear more fully from the following description.

DETAILED DESCRIPTION OF THE PREFERRED EMBODIMENTS

Figure 1:
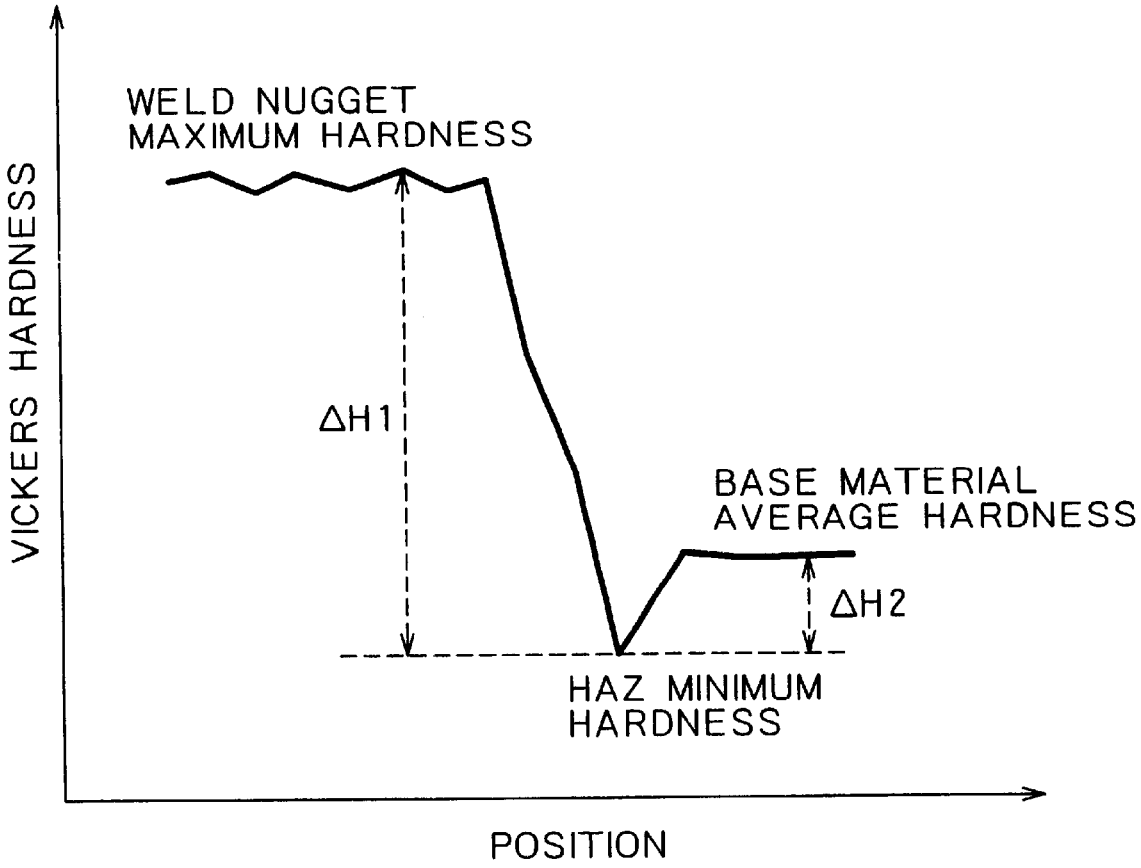
FIG. 1 is a conceptional view for evaluating the softening property in a weld heat-affected zone.

The present inventors have made various studies on both of the chemical compositions and the microstructures of steel in order to improve the fatigue limit for the welded joint portion in the dual-phase steel sheet having both superhigh-strength (about 780–1180 MPa) and the ductility.

As a result, the present invention has been accomplished based on the findings that when a steel sheet containing Cr and Mo each in a predetermined amount is used and heat treatment conditions (particularly, cooling rate in the annealing process after cold rolling) are property controlled, the hardness of the ferritic microstructure and the martensitic microstructure constituting the dual-phase steel sheet is improved compared with existent dual-phase steel sheets; and the steel sheet having a microstructure of such high hardness is excellent in the fatigue characteristic in the spot welded joint portion even when it is spot welded.

The basic chemical compositions constituting the steel sheet according to the invention will be explained below. It will be noted that all the units for the chemical compositions are based on mass%.

C: 0.08–0.20%

C is an essential element for ensuring a desired superhigh-strength. In the steel sheet according to the invention, desired superhigh-strength is insured by increasing the strength for each of microstructures constituting the steel sheet (ferrite and martensite). For this purpose, it has to be added by 0.08% or more, preferably, 0.10% or more and, more preferably, 0.13% or more. However, as the amount of C increases, large cracks reaching the surface of the molten portion are formed or micro-cracks or blow hole-like defects are frequently formed in welded nugget portions. This remarkably deteriorates mechanical characteristics of the welded joint portion. Accordingly, the upper limit is defined as 0.2%, preferably 0.18% or less and, more preferably 0.16% or less.

Si: 0.5% or Less (Inclusive of 0%)

When Si is added in excess of 0.5%, the phosphotability and hot dip coatability of the invented steel sheet are lowered. Accordingly, the upper limit is defined as 0.5%, preferably, 0.2% or less and, more preferably, 0.05% or less.

Mn: 3.0% or Less (Exclusive of 0%)

Mn is useful as an element for improving hardenability and, accordingly, it is desirably added by 1.5% or more preferably (1.8% or more). However, when it is added in excess of 3.0%, molten metal scattered by pressurization during welding, that is called expulsion or surface flash increases their viscosity and tend to be solidified again between sheets with no scattering. As a result, they tend to cause stress concentration near the welded zone to give undesired effects on the fatigue strength of the joint. Accordingly, the upper limit is defined as 3.0%, preferably, 2.8% and, more preferably, 2.5%.

P: 0.02% or less (inclusive of 0%)

Since the toughness in the weld zone is deteriorated when P is added in excess of 0.02%, the upper limit is defined as 0.02% (preferably, 0.01%).

S: 0.02% or less (inclusive of 0%)

Since S is an element also giving undesired effects on mechanical characteristics of the weld zone the same as in P, the upper limit is defined as 0.02% (preferably, 0.005%).

Al: 0.001 - 0.15%

Al is useful as a deoxidizing agent. As the agent, it is added by 0.001% or more, preferably 0.01% or more, and more preferably 0.02% or more. However, when it is over-added in amount, oxides remarkably increase in the steel to deteriorate the formability. Accordingly, the upper limit is defined as 0.15%, preferably 0.10%, and more preferably 0.08%.

In the invention, the chemical compositions described above are contained as the basic composition and, further, both of Cr and Mo are contained as the essential element within the range described below.

Mo: 0.05 - 1.5%

Mo is an excellent element for improving the hardenability and steel can be hardened stably by the addition of Mo. Further, martensite in the heat-affected zone is tempered and softened by heat input upon welding and Mo is useful for preventing such softening of martensite, as well as it improves the toughness of the nugget portion microstructure and contributes to the suppression of formation of micro-cracks. For effectively developing such an effect, it is recommended to add Mo by 0.05% or more, preferably 0.10% or more, and more preferably 0.15% or more. However, since it remarkably increases the cost when it is added in excess of 1.5%, the upper limit is defined as 3.0%, preferably 1.5%, and more preferably 1.0%.

Cr: 0.05–1.5%

Cr is an element of increasing the volume fraction of ferrite and, as a result, promoting concentration of the hardenability improving element in the austenite to improve the hardness of martensite. For effectively developing such an effect, Cr has to be added by 0.05% or more, preferably 0.10% or more, and more preferably 0.15% or more. However, when it is added in excess, the phosphatability is deteriorated by the effect of oxide layer formed on the surface of the steel sheet, as well as surface defects such as bare spot is liable to be caused in case of hot dip galvanizing. Accordingly, the upper limit is defined as 1.5% and, preferably 1.0% or less, and more preferably 0.6% or less.

In the invention, detailed reasons why desired hard microstructure can be obtained by addition of both Mo and Cr are not clear at present but it may be considered as below. That is, both of the elements are known as the hardenability improving element but the mechanisms are somewhat different. It is considered that Cr improves the hardenability indirectly by promoting the formation of ferrite, whereas Mo is an element of directly improving the hardenability of the austenite.

Accordingly, it is considered that since martensite can be hardened efficiently by the synergistic effect obtained only when both of them are used together and, at the same time, the solid solution-hardening elements are dispersed and concentrated in ferrite, they also contribute to the improvement of the hardness of the ferrite.

The steel of the invention contains the chemical compositions described above as the basic chemistry with the balance being substantially iron and impurities. However, it is recommended that the following elements can be controlled property within a range not deteriorating the function of the invention with an aim of ensuring more excellent characteristics.

B: 0.01% or Less (Exclusive of 0%). and/or

Ca: 0.01% or Less (Exclusive of 0%).

B is useful element for improving the hardenability. And Ca is useful for controlling the form of inclusions in steels which are deleterious to the improvement of the formability. For developing such effects effectively, it is recommended that each of them is added by 0.0002% or more, more preferably, 0.0005% or more. However, when each of the elements is added in excess of the upper limit 0.01%, it will remarkably increase the production cost, so that each of the upper limits is defined as 0.01%, more preferably 0.005%.

N and 0 form inclusions in the steel such as AlN and $Al_2O_3$ to result in deterioration of the formability, it is recommended that each of them is controlled to 0.01% or less, more preferably, 0.005% or less.

Ti, Nb and V are useful elements in forming fine carbides in the steel and promoting microstructure refinement thereby improving the anisotropy of the mechanical characteristics. However, like N and O described above, such elements also form impurities in steels to deteriorate the formability if they are excessive, so that it is recommended that each of them is controlled to 0.02% or less, more preferably, 0.01% or less.

The microstructure (ferrite and martensite) which in the most characterizing feature of the invention is to be explained.

As described above, the invention has been made as a result of study of maintaining the merit of the dual-phase steel sheet of good combination of high strength and high ductility and having preferred weldability and, further, improving the fatigue characteristic in the spot welded joint portion. Accordingly, the steel sheet according to the invention is based on the mixed microstructure of ferrite and martensite and may be composed only of such microstructures. However, within a range not deteriorating the function of the invention, other microstrudtures (bainite, retained austenite, etc.) may be included within a range of about 10% or less.

The invention has a most prominent feature in that the ferrite and the martensite constituting the dual-phase have an average Vickers hardness of 150 Hv or more for ferrite and 500 Hv or more for martensite, respectively.

Referring to the average Vickers hardness for each of the microstructures, Vickers hardness (1 g weight) for each microstructure present in the cross section of a sheet thickness parallel with the rolling direction (excluding a region from the surface to a depth corresponding to ⅛ of the sheet thickness) was measured at five points in total and they are expressed by an average value thereof. Measurement is conducted by a method based on ISO-DIS 6507-1 (metallic materials-Vickers hardness test-Part 1: Test method) and in accordance with JIS standards (JIS Z 2244) prepared with no substantial change for the technical content. Specifically, the average Vickers hardness is obtained by loading a test force of 1 g weight to the steel sheet cross section, releasing the test force and then measuring the length for the diagonal line of a dent remained on the surface of the steel material, substituting the value for a predetermined equation and expressing the hardness by an average of hardness (Vickers hardness) determined based on the test force and the surface area of the dent.

However, in a case where a dent extends over adjacent other microstructure, the measured value is excluded.

In a case of measuring the Vickers hardness for the ferritic microstructure and the martensitic microstructure by the measuring method described above, it may be a possibility that the Vickers hardness is measured including not only such microstructures but also including the microstructure present below the pressing direction in the strict sense. In the invention, values also including the hardness for such lower microstructures are defined as "Vickers hardness for the ferrite microstructure" and "Vickers hardness for the martensitic microstructure" respectively.

In the present invention, it is not always apparent for the detailed reasons why the fatigue characteristic of the spot welded joint is improved by increasing the hardness for each of the microstructures constituting the dual-phase steel sheet but it may be supposed as described below.

At first, it is considered that the degree for the softening of the heat affected zone can be minimized after the spot welding according to the steel sheet of the present invention. One of the reasons for lowering the fatigue characteristic in the spot welded joint is a large difference between the hardness of the base metal and the hardness of the heat-affected zone (HAZ). According to the invention, ferrite in the heat-affected zone is maintained hard as it is also after spot welding, and the martensite of the invention has a less temperable nature also after the spot welding, so that high hardness can be maintained and, as a result, softening in the heat affected zone can be suppressed remarkably.

Secondly, according to the invention, it is considered that a transformation phase of relatively low hardness can be maintained in the nugget portion. As another reason for lowering the fatigue characteristic of the spot welded joint, it may be considered that a low temperature transformed microstructure at high hardness is formed in the nugget. It is considered that since the volume fraction of the ferritic microstructure is relatively high compared with that in the conventional dual-phase steel sheet (to be described later), concentration of elements is remarkably decreased when the microstructure is transformed into a single phase by heat input upon welding and, as a result, the hardness for the nugget portion is also decreased.

It is considered that according to the invention, softening in the HAZ is remarkably suppressed and a low temperature transformation microstructure of a relatively high hardness is formed also in the nugget portion, so that stress concentration caused by repetitive loading is dispersed and development of fatigue cracks in the microstructure near the nuggets is suppressed and, as a result, the fatigue characteristic in the spot welded joint can be improved.

Such remarkable characteristics according to the invention can be expressed by the following relations (1) and (2):

$$\Delta H1\ (Hv) \leqq 140 \quad \ldots (1)$$

$$\Delta H2\ (Hv) \leqq 15 \quad \ldots (2)$$

where $\Delta H1$=[maximum hardness in the weld nugget] −[minimum hardness in *HAZ*]

$\Delta H2$=[average hardness in base material] −[minimum hardness in *HAZ*], respectively.

ΔH1 and ΔH2 are indexes for the evaluation of fatigue characteristic in the spot welded joint. It can be judged as the numerical values are smaller the fatigue characteristics is more excellent.

Among them, ΔH1 is a numerical representation of the second form, that is, "as a result of formation of a transformation phase of relatively low hardness in the nugget portion, the difference of hardness with the HAZ can be retained low compared with conventional steel sheets". As described in Examples to be shown later. It is considered that ΔH1 is generally increases as 150 Hv or more in existent dual-phase steel sheets and, as a result, the fatigue characteristic in the spot welded joint is lowered. ΔH1 is preferably 140 Hv or less and, more preferably, 120 Hv or less.

ΔH2 is the numerical representation of the first from described above that is, "since softening in the heat-affected zone is suppressed remarkably, the difference of the hardness between the base metal and the hardness of the heat-affected zone is suppressed low". As described in the examples shown later, it is considered that ΔH2 is generally as high as 20 Hv or more in conventional dual-phase steel sheets and, as a result, the fatigue characteristics in the spot welded joint is lowered. ΔH2 is preferably 15 Hv or less and, more preferably, 10 Hv or less.

The measuring method for ΔH1 and ΔH2 is as shown below.

FIG. 1 shows the outline of the measuring method. In the measurement, the Vickers hardness (500 g weight) at ¼ t (t: thickness) position in the direction of the thickness of one of the sheets constituting a welded joint was measured for the portion from the nugget center toward the base metal at 0.2 mm pitch till five points are measured in total in the base metal portion, in the same manner as in "measuring method for the Vickers hardness of the microstructure" described above.

Each of the microstructures is to be explained specifically.

Ferrite

"Ferrite" in the invention means mainly polygonal ferrite, that is, ferrite with less dislocation density but it also includes bainitic ferrite (having fine carbides precipitated in the ferritic phase).

"Ferrite" in the invention is different from ferrite in the conventional dual-phase steel sheet (about 140 Hv at the maximum) in that it has high hardness of 150 Hv or more.

As the ferrite hardness is higher, the effect of the invention can be attained more stably. It is preferably 170 Hv or more and, more preferably, 200 Hv or more. While the upper limit has no particular restriction in view of the development for the desired effect but, in view of the addition amount or the like of the chemical compositions in the steel specified in the invention, the upper limit for the hardness of the ferritic microstructure is about 270 Hv.

The feature of the invention is that the hardness of the ferritic microstructure is specified and there is no particular restriction for the volume fraction thereof so long as the microstructure satisfies the hardness described above. In order to obtain a desired superhigh-strength, it is recommended to make the volume fraction of the ferrite to the entire microstructure relatively higher compared with conventional duel phase steel sheets. This is because the combination of the high strength and the high elongation can further be improved.

Martensite

"Martensite" in the invention is a hard microstructure of high dislocation density and it is different from martensite in the conventional dual-phase steel sheets (about 480 Hv at the maximum) in that it has an average hardness of 500 Hv or more. In addition, the martensite described above has a feature that martensite in the heat-affected zone is less temperable even after spot welded. Accordingly, such hard martensite is useful for insuring a superhigh-strength, as well as also contributes to the improvement of the fatigue characteristic in the spot welded joint. For developing such an effect stably, it is recommended that the hardness is 550 Hv or more and, more preferably, 600 Hv or more. There is no particular restriction on the upper limit for developing of the desired function and When considering the addition amount of the specified chemical compositions in the steels in the invention, the upper limit for the hardiness of the martensite microstructure is generally at 800 Hv.

The invention has a feature in specifying the hardness of the martensitic microstructure and there is no particular restriction for volume fraction thereof so long as the microstructure satisfies the hardness described above and it is recommended that the volume fraction is properly controlled so as to provide a desired characteristic by the balance with the ferritic microstructure.

A method of manufacturing a steel sheet according to the invention is to be described.

The steel sheet according to the invention can be by adopting a method of by melting a steel satisfying predetermined chemical compositions to obtain a slab, hot rolling the same, optionally applying cold rolling and then applying an annealing treatment to obtain a desired steel sheet in the same manner as in the ordinary dual-phase steel sheet. Depending on the application use, the obtained steel sheet may further be applied with hot dip galvanizing and, optionally, applying a galvannealing treatment further.

Each of the steps is to be explained successively.

Steps Up to Formation of Slabs

The steps are not restricted particularly in the invention but steps adopted for ordinary dual-phase steel sheets may be properly selected and adopted. Specifically, steels satisfying the chemistries described above are prepared by melting in a converter furnace or an electric furnace and the chemical compositions of the obtained molten steel are controlled by using a degasing equipment, a refining equipment and the like. Then, a slab is obtained by casting the molten steel adjusted with the chemical compositions. Then, the molten steels adjusted with the chemical compositions are cast to obtain slabs, which may be conducted by either continuous casting or blooming milling after ingot casting.

Hot Rolling Step

The slab obtained by the method described above is heated and hot rolled. In this step, it is particularly recommended to cool at a cooling rate after the finish rolling.

Specifically, the slab is at first introduced into a hot rolling furnace. In this case, the slab may be introduced as a hot piece as it is into the hot rolling furnace, or the slab may be once cooled to a ordinary temperature and then introduced into the furnace.

Then, it is hot rolled to a predetermined sheet thickness i9 and then coiled. In this case, it is recommended to heat the slab at about 1050° C. to 1350° C., and then cooled at an average cooling rate after finish rolling at 40° C./sec or more, preferably 60° C./sec or more, and more preferably 80° C./sec or more, followed by coiling at a low temperature of about 600° C. or less and preferably 450° C. or less. This can prevent segregation in the hot rolling stage and the microstructure after the hot rolling becomes more fine and homogeneous and a desired high hardness dual phase can be obtained further easily.

There is no particular restriction on the upper limit of the cooling rate after the finish rolling but it is recommended to control it 150° C./sec or less (more preferably, from 120° C./sec or less) in view of increase in the installation cost.

Cold Rolling Step

After the hot rolling step, cold rolling may optionally be applied. Specifically, surface scales of the hot rolled steel strip obtained in the hot rolling process are removed by pickling and the strip is cold rolled at 20 to 60% cold rolling ratio. This is because rolling load increases making the cold rolling difficult when cold rolling is conducted at 60% or more.

Annealing Step (Depending on the Application use, Applied with Hot Dip Galvanizing further, Optionally, Galvannealing Treatment)

For obtaining the steel sheet according to the invention, it is particularly important to properly control the annealing process.

Specifically, for obtaining a desired highly hard microstructure, it is recommended to heat up to 750 to 850° C. (preferably 780 to 830° C.) at a heating rate of 1 to 8° C./sec (preferably 2 to 5° C./sec), and soaking the same at the temperature (soaking temperature) for one sec or more (preferably for 30 to 200 sec) cooling, followed 4 to a temperature of 500° C. or lower.

For cooling to 500° C. or lower after the soaking, it may be:

① cooled at an average cooling rate of 30° C./sec or more (preferably, 50° C./sec or more) all at once (one step cooling method), or ② cooled by two steps : that is, at first cooling at an average cooling rate of 10 to 50° C./sec (preferably, 15–30° C./sec) to 650–500° C. (primary cooling) and then cooling to 500° C. or lower at an average cooling rate of 20 to 100° C./sec (preferably, from 40 to 100° C./sec) (secondary cooling). In this case, it is recommended that the secondary cooling rate is higher than about 10–50° C./sec compared with the primary cooling rate.

Among them, when the latter, two step cooling method ② is adopted, since the volume fraction of ferrite is increased and concentration of the hardenability improving elements into austenite is promoted, it is extremely useful in that hardness of martensite is also improved.

The method according to the invention and the usual conventional production method of dual-phase steel sheets are compared.

According to the conventional method, the heating rate is as high as about 10 to 20° C./sec; the soaking temperature is as high as about 830 to 900° C.; and the average cooling rate after heating down to 500° C. or less is as slow as about 10° C./sec. No desired highly hard microstructure can be obtained under such heat treatment conditions as confirmed by examples to be described later. As described above, the method of the invention generally adopts a unique heat treatment controlling method of "heating rate is retarded, soaking temperature is made lower and the average cooling rate down to about 500° C. or lower of the zinc pot entry temperature is preferably made as that of two step cooling of rapid cooling", compared with the ordinary method. It is considered that desired fatigue characteristic not obtainable in the conventional dual-phase steel sheets can be attained in the combination of such heat treatment conditions and the chemical compositions in the steel described previously.

After cooling down to 500° C. or lower by the cooling method of ① and ② above, it may be applied with a isothermal possessing treatment (5 to 60 sec) or a tempering treatment for strength control (30 to 1000 sec) at the temperature region (about 300 to 500° C.). Further, there is no particular restriction on the cooling condition after cooling down to 500° C or lower by the s cooling method of ① and ②.

Subsequently, temper rolling may be applied with an aim of controlling the surface roughness of the steel sheet. In view of the deterioration of the ductility, it is recommended that the rolling ratio is controlled to 0.5% or less.

The series of annealing treatments described above may be continuous annealing or annealing in continuous galvanizing line.

In a case of obtaining a hot dip galvanizing steel sheet, after cooling the steel strip obtained by the annealing treatment described above, it may be dipped in a zinc pot and applied with a galvanizing treatment. The galvanizing treatment may be applied in continuous galvanizing line. There is no particular restriction on the conditions for the galvanizing treatment and the treatment may be applied by properly selected a usually adapted method, within a range not deteriorating the function of the invention. Spherically, it may be dipped in a zinc pot at an Al concentration of about 0.9 to 1.6% at a bath temperature of about 450 to 470° C. and controlled to a predetermined coating weight by gas wiping.

In a case of obtaining a hot dip galvannealing steel sheet, the hot dip galvanizing steel sheet (strip) obtained by the method described above may be further applied with an alloying treatment. The alloying treatment can be conducted in the continuous galvanizing line. There is no particular restriction on the conditions for the alloying treatment and usually adopted method may be properly selected and practiced within a range not deteriorating the function of the invention. Specifically, it is directly heated by a burner or the like or inductively heated by an induction heater. It is generally practiced to rapidly heat at a high temperature in the initial stage of alloying and then heat moderately at a lower temperature subsequently.

The invention is to be describe more in details with reference to examples. However, the examples to follow do not restrict the invention but any practice with modification within a range not departing the gist described above and to be described later included in the technical scope of the invention.

EXAMPLE

After melting and preparing steels of the chemical compositions shown in Table 1 (steel species A–K) in a converter furnace, chemical compositions were controlled in a refining equipment out of the furnace and slabs of 230 mm thickness was obtained by continuous casting. After heating the obtained slabs at 1150° C., they were roughly rolled and hot rolled at a finishing temperature of 860° C. to obtain hot rolled steel strip of 2.5 mm thickness. Subsequently, they were cooling at an average cooling rate of 80° C./sec or more and coiled at 420° C. After pickling and removing the surface scales of the resultant steel strip, they were cold rolled to a sheet thickness of 1.2 mm.

TABLE 1

(mass %)

| Steel | C | Si | Mn | P | S | Al | Mo | Cr | N | O | Others | Remarks |
|---|---|---|---|---|---|---|---|---|---|---|---|---|
| A | 0.10 | 0.02 | 1.96 | 0.001 | 0.006 | 0.034 | 0.24 | 0.16 | 0.0028 | 0.0012 | | Inventive steel |
| B | 0.14 | 0.01 | 2.41 | 0.004 | 0.001 | 0.44 | 0.43 | 0.28 | 0.0015 | 0.0029 | | Inventive steel |
| C | 0.16 | 0.21 | 2.64 | 0.009 | 0.003 | 0.018 | — | — | 0.0031 | 0.0037 | | Comparative steel |
| D | 0.18 | 0.04 | 1.99 | 0.011 | 0.001 | 0.051 | — | 0.54 | 0.0022 | 0.0024 | | Comparative steel |
| E | 0.23 | 0.01 | 2.88 | 0.003 | 0.003 | 0.029 | 0.07 | 0.39 | 0.0030 | 0.0009 | | Comparative steel |
| F | 0.11 | 0.52 | 1.65 | 0.009 | 0.002 | 0.028 | 0.17 | 0.06 | 0.0019 | 0.0017 | | Inventive steel |
| G | 0.18 | 1.33 | 2.06 | 0.005 | 0.002 | 0.028 | 0.43 | — | 0.0026 | 0.0021 | | Comparative steel |
| H | 0.11 | 0.16 | 2.28 | 0.012 | 0.002 | 0.039 | 0.31 | 0.18 | 0.0026 | 0.0021 | | Inventive steel |
| I | 0.12 | 0.02 | 2.23 | 0.011 | 0.002 | 0.040 | 0.31 | 0.53 | 0.0031 | 0.0018 | Ca: 0.008 | Inventive steel |
| J | 0.15 | 0.02 | 2.14 | 0.018 | 0.007 | 0.033 | 0.47 | 0.18 | 0.0030 | 0.0030 | B: 0.0010 | Inventive steel |
| K | 0.11 | 0.11 | 2.37 | 0.010 | 0.002 | 0.032 | 0.35 | 0.15 | 0.0025 | 0.0022 | | Inventive steel |

TABLE 2

| Sample No. | Steel | Heating rate (° C./sec) | Soaking (temperature ° C. × Hr sec) | Primary Cooling rate (° C./sec) | Primary cooling end temperature (° C.) | Secondary cooling (° C./sec) | Secondary cooling end temperature (° C.) | Subsequent coling | Remarks |
|---|---|---|---|---|---|---|---|---|---|
| 1 | A | 5 | 800 × 90 | 30 | 600 | 45 | 480 | Air cooling | Inventive example |
| 2 | B | 5 | 780 × 90 | 30 | 500 | — | — | Air cooling | Inventive example: Kept at 500° C. for 5 sec after primary cooling |
| 3 | C | 5 | 800 × 90 | 30 | 600 | 45 | 480 | Air cooling | Comparative example |
| 4 | D | 5 | 780 × 90 | 30 | 500 | — | — | Air cooling | Comparative example: |

TABLE 2-continued

| Sample No. | Steel | Heating rate (° C./sec) | Soaking (temperature ° C. × Hr sec) | Primary Cooling rate (° C./sec) | Primary cooling end temperature (° C.) | Secondary cooling (° C./sec) | Secondary cooling end temperature (° C.) | Subsequent coling | Remarks |
|---|---|---|---|---|---|---|---|---|---|
| | | | | | | | | | Kept at 500° C. for 5 sec after primary cooling |
| 5 | E | 5 | 800 × 90 | 30 | 720 | 40 | 480 | Air cooling | Comparative example |
| 6 | F | 5 | 800 × 60 | 30 | 650 | Water quenching | — | — | Inventive example |
| 7 | G | 10 | 800 × 60 | 30 | 650 | Water quenching | — | — | Comparative example |
| 8 | H | 5 | 780 × 45 | 30 | 720 | 45 | 480 | Air cooling | Inventive example |
| 9 | I | 5 | 780 × 45 | 30 | 720 | 45 | 480 | Air cooling | Inventive example |
| 10 | J | 5 | 800 × 90 | 30 | 720 | 45 | 480 | Air cooling | Inventive example |
| 11 | K-1 | 5 | 800 × 90 | 30 | 720 | 45 | 480 | Air cooling | Inventive example |
| 12 | K-2 | 20 | 800 × 90 | 30 | 720 | 45 | 480 | Air cooling | Comparative example |
| 13 | K-3 | 5 | 860 × 90 | 30 | 720 | 45 | 480 | Air cooling | Comparative example |
| 14 | K-4 | 5 | 800 × 90 | 5 | 720 | 15 | 480 | Air cooling | Comparative example |

Then, after conducting an annealing treatment for Nos. 1 to 5 and 8 to 14 shown in Table 2 by the continuous galvanizing line, coating was applied by 45 g/m$^2$ on one surface in a zinc pot (zinc pot temperature:465° C.). Then, after applying an alloying treatment, and cooling to 150° C. at an average cooling rate of 20° C. /sec, they were water-cooled and further applied with temper rolling at 0.2% strain.

Nos. 6–7 in Table 2 are examples applied with the annealing treatment not in the continuous galvanizing line but in a continuous annealing line. After soaking and cooling at conditions shown in Table 2, they were water-quenched. After water-quenching, they were re-heated for controlling the strength to 230° C. at 7° C./sec and then tempered at 230° C.×10 min and temper rolled (0.2% strain) although not shown in Table 2.

Nos. 1, 3, 5, 8–14 in Table 2 are examples adopting the two step cooling method described above, and other Nos. 2 and 4 are examples not adopting the two step cooling method but a one step cooling method.

For the thus obtained steel sheets, the hardness for each of the microstructures of ferrite and martensite were measured by the method described above. Further, the tensile strength (TS), elongation [total elongation (EI)] and yield strength (YP) were measured for the steel sheets described above by using JIS No. 5 test specimens.

Further, spot welding was conducted by the following method, the hardness (ΔH1 and ΔH2 were measured for the spot welded joint by the method described above and the fatigue limit of the joint was measured by the following procedure.

[Spot Welding]

Using a dome radius type electrode with a top diameter of 6 mm, and after previously confirming a welding current value of forming a nugget with a diameter of $5\times\sqrt{t}$ [t: thickness of steel sheet (mm)] under the conditions for a welding time of 20 cycle and at holding for one cycle and at an electrode force of 4160 kgf, identical steel sheets were combined with each other to prepare a predetermined joint shear tension fatigue test piece and put to the following test at the welding current described 39 above.

[Fatigue limit of the Spot Welded Joint]

The fatigue test was conducted in accordance with the method specified in JIS Z3138 at a repetitive cycle, of up to $10^7$.

The results are shown in Table 3.

TABLE 3

| No. | YP (MPa) | TS (MPa) | EI (%) | Matrix ferrite hardness (Hv) | Matrix martensite hardness (Hv) | Weld nugget maximum hardness (Hv) | HAZ minimum hardness (Hv) | Base material average hardness (Hv) | ΔH1 (Hv) | ΔH2 (Hv) | Fatigue limit (N) | Remarks |
|---|---|---|---|---|---|---|---|---|---|---|---|---|
| 1 | 543 | 853 | 19 | 213 | 546 | 404 | 276 | 282 | 128 | 6 | 1550 | Inventive example |
| 2 | 692 | 1088 | 15 | 224 | 593 | 428 | 337 | 344 | 91 | 7 | 1600 | Inventive example |
| 3 | 554 | 831 | 14 | 147 | 445 | 461 | 233 | 260 | 228 | 27 | 950 | Comparative example |
| 4 | 492 | 828 | 16 | 128 | 452 | 465 | 225 | 249 | 240 | 24 | 1000 | Comparative example |
| 5 | 730 | 1132 | 9 | 167 | 491 | 532 | 347 | 367 | 185 | 20 | 1050 | Comparative example |
| 6 | 516 | 843 | 22 | 208 | 520 | 387 | 268 | 278 | 119 | 10 | 1500 | Inventive example |
| 7 | 680 | 1044 | 14 | 147 | 483 | 494 | 303 | 331 | 191 | 28 | 1150 | Comparative example |
| 8 | 618 | 955 | 18 | 178 | 533 | 418 | 297 | 306 | 121 | 9 | 1450 | Inventive example |
| 9 | 648 | 1058 | 12 | 166 | 554 | 432 | 335 | 340 | 97 | 5 | 1600 | Inventive example |
| 10 | 705 | 1102 | 11 | 215 | 589 | 442 | 324 | 331 | 118 | 7 | 1550 | Inventive example |
| 11 | 599 | 977 | 15 | 168 | 510 | 437 | 302 | 310 | 135 | 8 | 1350 | Inventive example |
| 12 | 587 | 969 | 15 | 132 | 487 | 430 | 278 | 301 | 152 | 23 | 1100 | Comparative example |
| 13 | 573 | 934 | 16 | 136 | 471 | 432 | 272 | 292 | 160 | 20 | 1050 | Comparative example |
| 14 | 556 | 966 | 14 | 115 | 501 | 451 | 264 | 303 | 187 | 39 | 1050 | Comparative example |

From Table 3, it can be considered as below.

At first, Nos. 1, 2, 6, 8–11 in Table 3 are examples of the invention having the constituent factors of the invention and it can be seen that they have superhigh-strength, satisfactory elongation to the strength, and in addition, they are excellent in the fatigue characteristic in the spot welded joint.

On the contrary, comparative examples for Nos. 3–5, 7, 12–14 not satisfying the constituent of the invention are poor in the characteristics described above. Particularly, the fatigue limit in the spot welded joint in the comparative examples was as low about as ⅔ or less compared with examples of the invention and, in addition, the hardness of the joints ΔH1 and ΔH2 is extremely high, so that it can be seen that they are poor in the fatigue characteristic of the spot welded joint.

More specifically, No. 3 at first, is a comparative example not containing Mo and Cr. Although one step cooling method specified in the invention was practiced, the hardness for the ferritic microstructure and the martensitic microstructure was low failing to obtain desired characteristics.

No. 4 is a comparative example not containing Mo. Although two step cooling method specified in the invention was practiced, the hardness of the ferritic microstructure and the martensitic microstructure was low failing to obtain desired characteristics.

No. 7 is a comparative example not containing Cr and with the heating rate being as high as 10° C./sec. The hardness of the ferritic microstructure and the martensitic microstructure was low failing to obtain desired characteristics.

No.5 is a comparative example of high C content. Although the two step cooling method specified in the invention was practiced, since the hardness of the martensitic microstructure was low no desired characteristics were obtained.

Nos. 12 to 14 are comparative examples using steel species K satisfying the chemical compositions for the invention with the heat treatment conditions being changed variously. Among them, No. 12 is an example in which the heating rate is as high as 20° C./sec: No. 13 is an example in which the soaking temperature is as high as 860° C. and No. 14 is an example in which the secondary cooling rate is as slow as 15° C./sec. Since none of them can provide desired highly hard microstructure, no satisfactory characteristic were obtained.

The present invention is extremely useful, since the satisfactory characteristics (high strength and high ductility) of the conventional dual-phase steel sheet are maintained as they are and, in addition, the fatigue characteristic for the spot welded joint, which has been a subject for long years in the conventional steel sheets, can be improved remarkably.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A superhigh-strength dual-phase sheet having a tensile strength of at least about 780 MPa of excellent fatigue characteristic in a spot welded joint containing a ferritic microstructure and a martensitic microstructure containing:

C: 0.08–0.20% (mass% hereinafter),

Si: 0.5% or less (inclusive of 0%)

Mn: 3.0% or less (exclusive of 0%)

P: 0.02% or less (inclusive of 0%)

S: 0.02% or less (inclusive of 0%), and

Al: 0.001–0.015%, which further contains

Mo: 0.05–1.5%, and

Cr: 0.05–1.5%, and satisfying:

the average Vickers hardness of the ferritic microstructure of 150 Hv or more and the average Vickers hardness of the martensitic microstructure of 500 Hv or more.

2. A superhigh-strength dual-steel sheet having a tensile strength of at least about 780 MPa of excellent fatigue characteristic in a spot welded joint containing a ferritic microstructure and martensitic microstructure containing:

C: 0.08–0.20% (mass% here and hereinafter)

Si: 0.5% or less (inclusive of 0%)

Mn: 3.0% or less (exclusive of 0%)

P: 0.02% or less (inclusive of 0%)

S: 0.02% or less (inclusive of 0%), and

Al: 0.001–0.015%, which further contains

Mo: 0.05–1.5%, and

Cr: 0.05–1.5%, and satisfying that the difference between the maximum hardness for the weld nugget and the minimum hardness for the heat-affected zone (ΔH1) is 140 or less and a difference between the average hardness for the base metal and the minimum hardness for the heat-affected zone (ΔH2) is 15 or less.

3. A superhigh-strength dual-phase steel sheet as defined in claim 1 further containing:

Ca: 0.01% or less (exclusive of 0%), and/or

B: 0.01% or less (exclusive of 0%).

4. A superhigh-strength dual-phase steel sheet as defined in claim 1, which is further applied with hot dip galvanizing.

5. A superhigh-strength dual-phase steel sheet as defined in claim 4, which is further applied with a galvannealing treatment.

6. A superhigh-strength dual-phase steel sheet as defined in claim 1, and satisfying that the difference between the maximum hardness for the weld nugget and the minimum hardness for the heat-affected zone (ΔH1) is 140 or less and a difference between the average hardness for the base metal and the minimum hardness for the heat-affected zone (ΔH2) is 15 or less.

7. A superhigh-strength dual-phase steel sheet as defined in claim 6 further containing:

Ca: 0.01% or less (exclusive of 0%), and/or

B: 0.01% or less (exclusive of 0%).

8. A superhigh-strength dual-phase steel as defined in claim 6 having a tensile strength of about 780 to 1180 MPa.

9. A superhigh-strength dual-phase steel as defined in claim 8 the Ti, Nb or V content of which is less than 0.02% (inclusive of 0%).

* * * * *

UNITED STATES PATENT AND TRADEMARK OFFICE

CERTIFICATE OF CORRECTION

PATENT NO. : 6,709,535 B2
DATED : March 23, 2004
INVENTOR(S) : Utsumi et al.

It is certified that error appears in the above-identified patent and that said Letters Patent is hereby corrected as shown below:

Title page,
Item [73], should read
-- [73] Assignee: Kabushiki Kaisha Kobe Seiko Sho (Kobe Steel, Ltd.)
Kobe (JP) --

Signed and Sealed this

Twenty-second Day of June, 2004

JON W. DUDAS
*Acting Director of the United States Patent and Trademark Office*